US008721067B2

(12) United States Patent
Kobayashi et al.

(10) Patent No.: US 8,721,067 B2
(45) Date of Patent: May 13, 2014

(54) PRINTER APPARATUS

(75) Inventors: Hisayuki Kobayashi, Nagano (JP); Takaaki Kambara, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 312 days.

(21) Appl. No.: 13/254,858

(22) PCT Filed: Mar. 13, 2009

(86) PCT No.: PCT/JP2009/054939

§ 371 (c)(1),
(2), (4) Date: Sep. 5, 2011

(87) PCT Pub. No.: WO2010/103664

PCT Pub. Date: Sep. 16, 2010

(65) Prior Publication Data

US 2011/0316924 A1 Dec. 29, 2011

(51) Int. Cl.
*B41J 2/01* (2006.01)

(52) U.S. Cl.
USPC ..... 347/104; 347/16; 347/5

(58) Field of Classification Search
USPC ..... 347/2, 4, 5, 104, 16, 9
See application file for complete search history.

(56) References Cited

U.S. PATENT DOCUMENTS

2004/0239742 A1* 12/2004 Hiraki et al. ..... 347/104

FOREIGN PATENT DOCUMENTS

| | | |
|---|---|---|
| JP | 2000-135827 | 5/2000 |
| JP | 2002-301842 | 10/2002 |
| JP | 2004-291325 | 10/2004 |
| JP | 2008-201107 | 9/2008 |

* cited by examiner

*Primary Examiner* — Lam S Nguyen
(74) *Attorney, Agent, or Firm* — Jianq Chyun IP Office

(57) ABSTRACT

A printer apparatus (10) is provided with a front and rear drive motor, which rotationally drives a feed roller (21) in a state that the plate-like medium (B) is pinched by the feed roller (21) and a pinch roller (24) which are paired to feed the plate-like medium (B) to the front side and to set to be located on the platen (13), a right and left drive motor which moves the printer head (32) in the right and left direction, and a controller which performs control for feeding the plate-like medium (B) and control for moving the printer head by the right and left drive motor (32). The platen (13) is provided with a feeding auxiliary member (40) which is protruded from a support face for supporting the plate-like medium (B) and is located on the front side with respect to a portion facing the printer head (32).

4 Claims, 10 Drawing Sheets

Start of Printing

PRINTER APPARATUS

CROSS-REFERENCE TO RELATED APPLICATION

This application is a 371 of international application of PCT application serial no. PCT/JP2009/054939, filed on Mar. 13, 2009. The entirety of the above mentioned patent application is hereby incorporated by reference herein and made a part of this specification.

TECHNICAL FIELD

The present invention relates to a printer apparatus in which ink is ejected from a printer head to perform printing on a printing medium and, more specifically, relates to a printer apparatus which is capable of printing on a plate-like printing medium.

BACKGROUND ART

Conventionally, a printer apparatus (inkjet printer) has been known in which control for feeding a printing medium formed of a sheet-like material (hereinafter, referred to as a sheet-like medium) in a front and rear direction with respect to a platen and control for ejecting ink while moving a printer head facing the platen in a right and left direction are performed in a combined manner to perform printing on the printing medium. In recent years, in addition to a sheet-like medium, a printing medium formed of a plate-like material (hereinafter, referred to as a plate-like medium) has been required to be printed by the printer apparatus. In order to cope with the requirement, for example, a structure has been known in which a support member for horizontally supporting a plate-like medium is provided on a front side and a rear side of the platen. According to this structure, a plate-like medium is fed in the front and rear direction while being horizontally supported and printing can be performed on the plate-like medium.

For example, in FIG. 3 in Japanese Patent Laid-Open No. 2002-301842, a structure is disclosed in which a first support arm 101 and a second support arm 103 are provided on a front side and a rear side of a platen 10 to support a plate-like medium 20 horizontally and the plate-like medium 20 is moved in the front and rear direction by means of rotating a feed roller 15 is rotated. In the structure shown in FIG. 3 in Japanese Patent Laid-Open No. 2002-301842, the plate-like medium 20 is moved in the front and rear direction while an under face of the plate-like medium 20 is slid on an upper face of the platen 10 by the rotated feed roller 15.

DISCLOSURE OF THE INVENTION

Technical Problem To Be Solved

Recently, a large-scale plate-like medium (for example, whose width in the right and left direction is about lm and whose length in the front and rear direction is about 1.6m) is required to be printed. In a case that printing is performed on such a large-scale plate-like medium by using the structure shown in FIG. 3 in Japanese Patent Laid-Open No. 2002-301842, since a contacting area of the plate-like medium with the platen 10 is wide, sliding resistance between the upper face of the platen 10 and the under face of the plate-like medium is increased and thus an excessive load may be applied to the feed roller 15. When an excessive load is applied to the feed roller 15 as described above, for example, a slip may be easily occurred at an abutting portion of the feed roller 15 with the plate-like medium and thus it is difficult to feed the plate-like medium in the front and rear direction with a high degree of accuracy while its positional accuracy is secured and, as a result, printing quality may be lowered.

In view of the problems described above, an objective of the present invention is to provide a printer apparatus in which a plate-like medium is fed in the front and rear direction with a high degree of accuracy and, as a result, printing quality is improved.

Solution to Problem

In order to attain the above-mentioned objective, the present invention provides a printer apparatus in which ink is ejected to perform printing on a printing medium (for example, a sheet-like medium "S" or a plate-like medium "B" in the embodiment) while a printer head facing the printing medium is relatively moved in a feeding direction and a scanning direction perpendicular to each other with respect to the printing medium that is supported by a medium support means (for example, the platen 13 in the embodiment) for supporting the printing medium, the printer apparatus including:

a medium feeding mechanism (for example, the front and rear drive motor 25 in the embodiment) in which, in a state that the printing medium is pinched by pinching rollers (for example, the feed roller 21 and the pinch roller 24 in the embodiment) that are paired and disposed on an upstream side in the feeding direction with respect to the medium support means, one of the pinching rollers is driven and rotated to feed the printing medium in the feeding direction so that the printing medium is located on the medium support means;

a head moving mechanism (for example, the right and left drive motor 39 in the embodiment) which moves the printer head in the scanning direction; and a print control part (for example, the controller 19 in the embodiment) which performs control for feeding the printing medium by the medium feeding mechanism and control for moving the printer head by the head moving mechanism.

The medium support means is provided with a feeding auxiliary member which is protruded with respect to a support face that supports the printing medium on a downstream side in the feeding direction with respect to a portion facing the printer head.

In the present invention, it is preferable that the feeding auxiliary member is provided with a support shaft (for example, the shaft member 42 in the embodiment) and a rotation member (for example, the support roller 41 in the embodiment) which is rotationally attached to the support shaft, and the feeding auxiliary member is attached to the medium support means so that the support shaft is directed in the scanning direction, and an upper part of the rotation member is protruded on an upper side with respect to the support face.

Further, it is preferable that, in a case that a plate-like printing medium (for example, the plate-like medium "B" in the embodiment) is used as the printing medium, the plate-like printing medium being extended longer in the feeding direction than a length in the feeding direction of the medium support means and, when printing is to be performed while the plate-like printing medium is supported and fed in the feeding direction, an upstream side support base (for example, the rear side support base 60 in the embodiment) is provided on the upstream side in the feeding direction with respect to the pinching rollers, the upstream side support base being detachably attached to the printer apparatus for supporting an unprinted portion of the plate-like printing medium, a downstream side support base (for example, the front side support base 70 in the embodiment) is provided on the downstream side in the feeding direction with respect to the medium support means, the downstream side support base being detachably attached to the printer apparatus for supporting a portion having been printed of the plate-like printing medium, and the plate-like printing medium is supported by the upstream side support base and the downstream side support base and supported by the pinching rollers and the feeding auxiliary member and the plate-like printing medium is fed in a state separated from the support face.

It is preferable that each of the upstream side support base and the downstream side support base is structured of a medium support rail (for example, the feeding rail 61 and the feeding rail 71 in the embodiment), which supports the plate-like printing medium, and a rail support leg (for example, the support leg 63 in the embodiment) which is extended to a lower side with respect to the medium support rail for supporting the medium support rail, an upstream side in the feeding direction of the medium support rail is located on an upper side or in a substantially horizontal state with respect to a downstream side in the feeding direction by means of adjusting an inclination angle of the medium support rail with respect to the rail support leg, and a vertically positional relationship between an end part on the downstream side in the feeding direction of the upstream side support base and the pinching rollers is adjustable, and a vertically positional relationship between an end part on the upstream side in the feeding direction of the downstream side support base and the medium support means is adjustable.

Effects of Invention

The printer apparatus in accordance with the present invention is structured so that the medium support means is provided with the feeding auxiliary member, which is protruded with respect to the support face, on a downstream side in the feeding direction with respect to a portion facing the printer head. According to this structure, for example, when printing is to be performed on a plate-like printing medium having a certain degree of rigidity, the printing medium is fed in a supported state by the pinching rollers and the feeding auxiliary member and thus the printing medium and the medium support means can be prevented from directly contacting with each other. Therefore, for example, when printing is to be performed on a large-scale and heavy plate-like printing medium, sliding resistance occurring between the plate-like printing medium and the medium support means is reduced and thus the plate-like printing medium can be fed by a relatively small force. Accordingly, a slip does not occur in the abutting portion of the pinching roller for feeding the plate-like printing medium in the feeding direction with the plate-like printing medium and thus the plate-like printing medium is fed in the feeding direction with a high degree of accuracy while securing its positional accuracy and a high-quality printing is attained.

In the present invention, it is preferable that the feeding auxiliary member is provided with a support shaft and a rotation member which is rotationally attached to the support shaft and the upper part of the rotation member is protruded to an upper side with respect to the support face of the medium support means. According to this structure, for example, when the plate-like printing medium is to be fed in the feeding direction, since the rotation member supports the plate-like printing medium while being rotated, the plate-like printing medium is fed in the feeding direction smoothly. Therefore, a slip does not occur in the abutting portion of the pinching roller with the plate-like printing medium and thus the plate-like printing medium is fed in the feeding direction with a high degree of accuracy.

Further, it is preferable that, when printing is to be performed on a plate-like printing medium which is longer than a length in the feeding direction of the medium support means, an upstream side support base and a downstream side support base are provided for supporting the plate-like printing medium. According to this structure, the plate-like printing medium can be fed on the medium support means so as to be substantially horizontal state and the plate-like printing medium is supported by the pinching roller and the feeding auxiliary member and can be fed in a separated state from the support face on the medium support means. Therefore, sliding resistance occurring between the plate-like printing medium and the medium support means is reduced and thus the plate-like printing medium can be fed with a small force.

It is preferable that each of the upstream side support base and the downstream side support base is structured of a medium support rail which supports the plate-like printing medium, and a rail support leg for supporting the medium support rail, and an inclination angle of the medium support rail with respect to the rail support leg is adjustable. When an inclination angle of the medium support rail of each of the upstream side support base and the downstream side support base is set so that, for example, its upstream side in the feeding direction is a little higher, the plate-like printing medium is fed from a higher position to a lower position as a whole at the time of feeding in the feeding direction. Therefore, the plate-like printing medium can be fed in the feeding direction smoothly without operating against the gravity.

BRIEF DESCRIPTION OF DRAWINGS

FIG. 1 is a perspective view showing a printer apparatus (state where printing is performed on a sheet-like medium) to which the present invention is applied.

FIG. 2 is a perspective view showing a printing unit and its vicinity of the printer apparatus.

FIG. 3 is a perspective view showing a platen of the printer apparatus.

FIG. 4 is a cross-sectional view showing a IV-IV portion in FIG. 3.

FIG. 5 is a perspective view showing the printer apparatus (state where printing is performed on a plate-like medium) which is viewed from an obliquely front side.

FIG. 6 is a perspective view showing the printer apparatus (state where printing is performed on a plate-like medium) which is viewed from an obliquely rear side.

FIG. 7 is a side view showing a state when printing on a plate-like medium is started.

FIG. 8 is a side view showing a state when printing on a plate-like medium has been finished.

FIG. 9 is a side view showing a rear side support base when it is not used (at the time of storage).

FIG. 10 is a side view showing a state where a plate-like medium is supported under a state where an inclination angle is changed and printing is performed.

DESCRIPTION OF EMBODIMENTS

Figure 1:
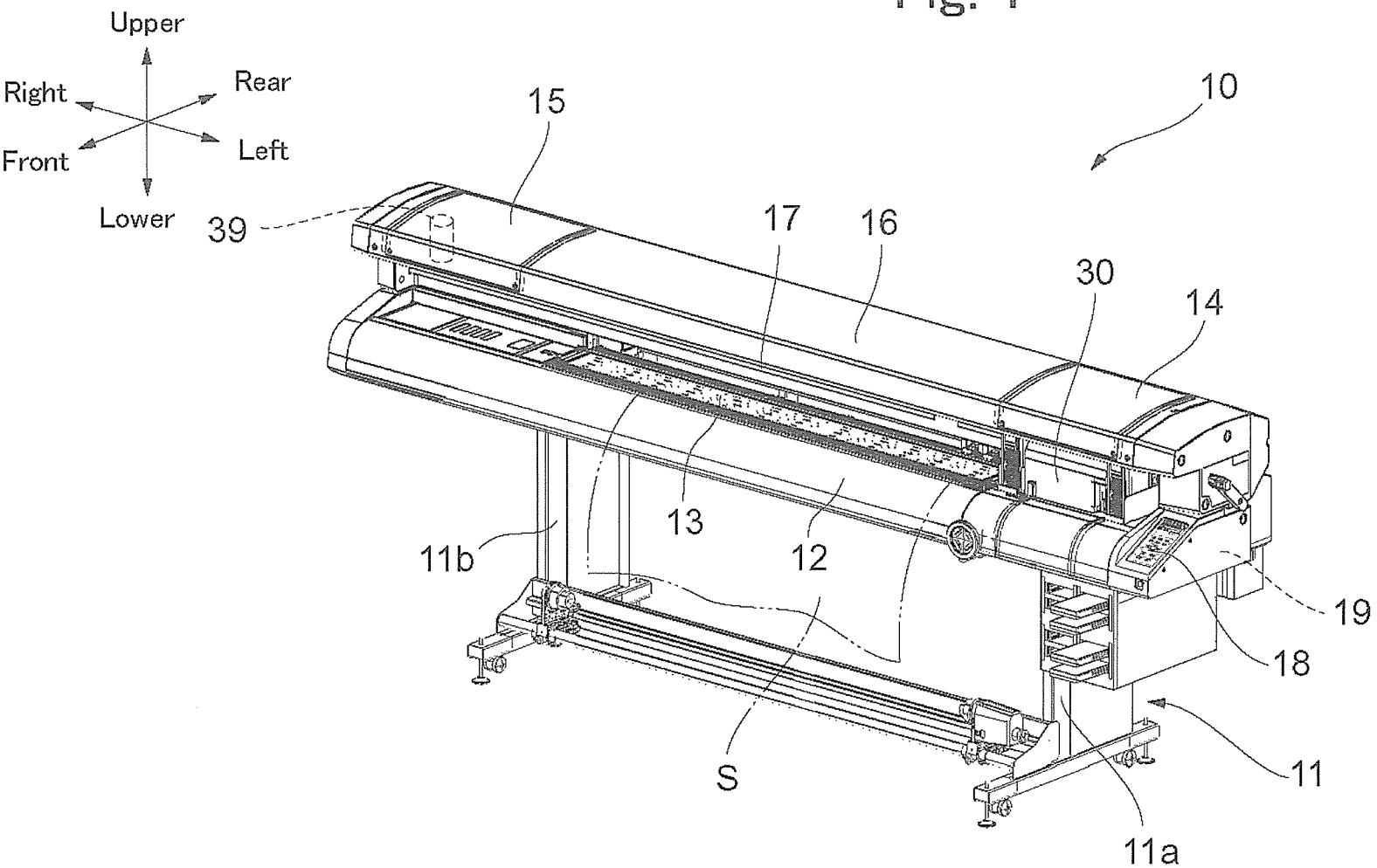
[FIG.1]

A preferred embodiment of the present invention will be described below with reference to the accompanying drawings. In the following description, directions in the drawings indicated by the arrows are respectively defined as right and left, front and rear and upper and lower for convenience of description.

Figure 4:
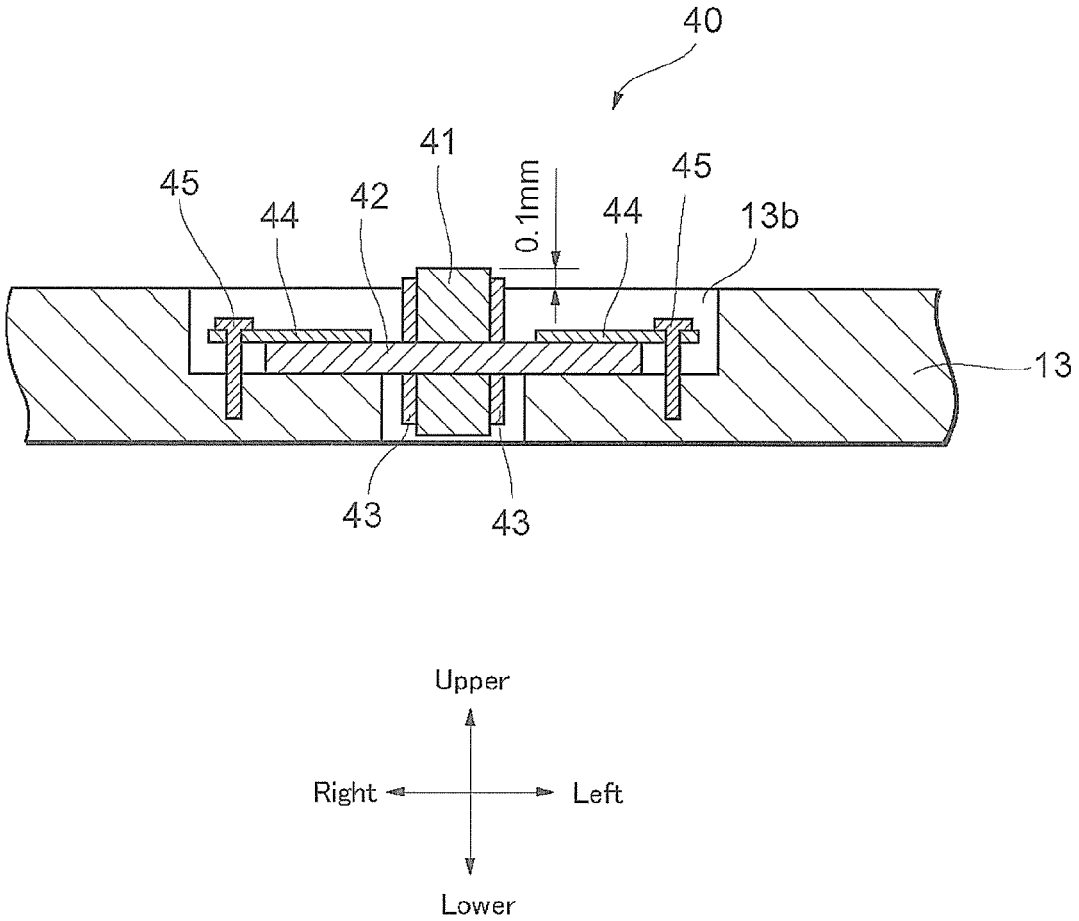
[FIG.4]
Figure 5:
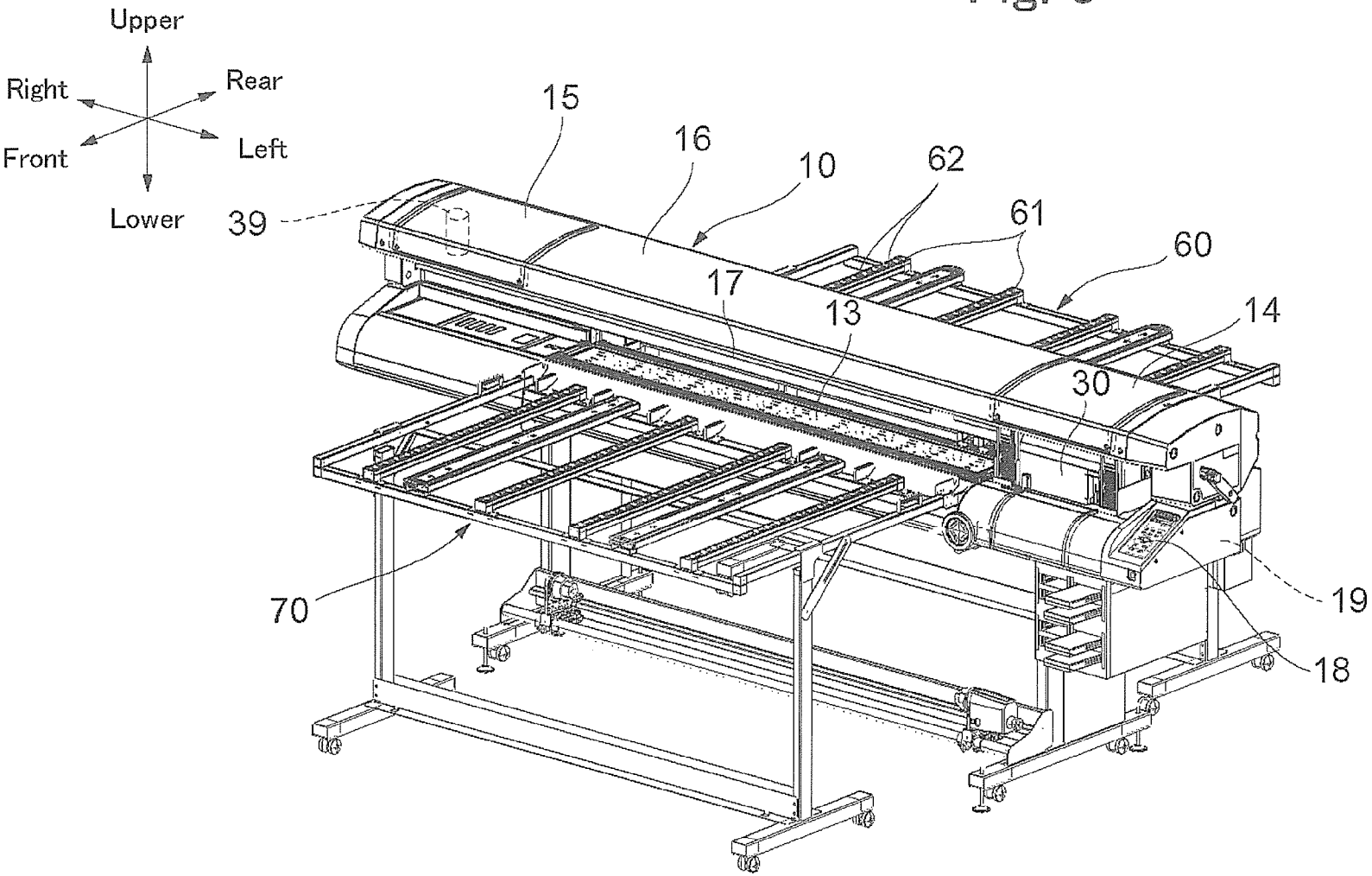
[FIG.5]
Figure 6:
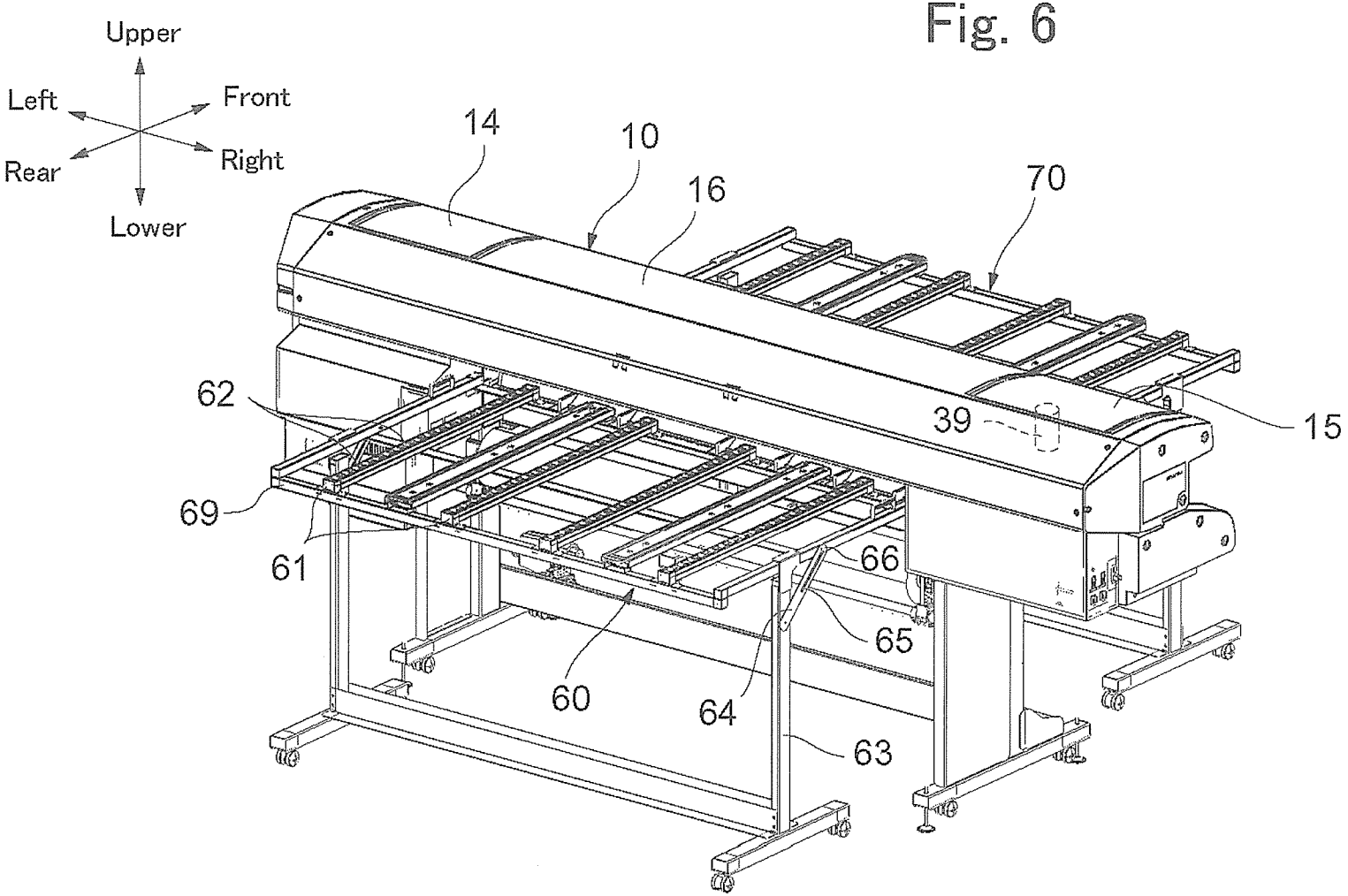
[FIG.6]

A structure of a printer apparatus 10 to which the present invention is applied will be described below with reference to FIGS. 1 through 6. The printer apparatus 10 is originally structured as shown in FIG. 1 and printing can be performed on a sheet-like medium "S" by using this structure. On the other hand, when printing is to be performed on a plate-like medium, as shown in FIGS. 5 and 6, a rear side support base 60 and a front side support base 70 which will be described below are attached to the printer apparatus 10. As described above, the printer apparatus 10 is capable of printing for both of a sheet-like medium "S" and a plate-like medium. In the following description, as an example, a structure will be described in which printing is performed by using an ultraviolet curing type ink (hereinafter, referred to as "UV" ink) which is cured by irradiation of ultraviolet rays.

The printer apparatus 10 is, as shown in FIG. 1, structured of a support leg 11 having right and left support legs 11*a* and 11*b*, a center body part 12 supported by the support leg 11, a left body part 14 provided on a left side of the center body part 12, a right body part 15 provided on a right side of the center body part 12, and an upper body part 16 which connects the right and left body parts 14 and 15 with each other and is extended on an upper side of the center body part 12 in a separated and parallel manner. The center body part 12 is provided with a flat plate-shaped platen 13 which is exposed on its upper face and extended in the right and left direction. An operation part 18 which is structured of operation switches, display devices and the like is provided on a front face side at a left end part of the center body part 12.

The left end part of the center body part 12 is incorporated with a controller 19. The controller 19 outputs operation signals to respective structure parts of the printer apparatus 10 which will be described below to drive and control the respective structure parts. Specifically, the controller 19 drives and controls a vertically moving mechanism (not shown), a front and rear drive motor 25, printer heads 32, a right ultraviolet ray irradiation device 33R, a left ultraviolet ray irradiation device 33L, and a right and left drive motor 39, and the like which will be described below. A guide rail 17 extended in the right and left direction is provided on a front face side at a lower part of the upper body part 16. A printing unit 30 is attached to the guide rail 17 so as to be movable in the right and left direction.

Figure 2:
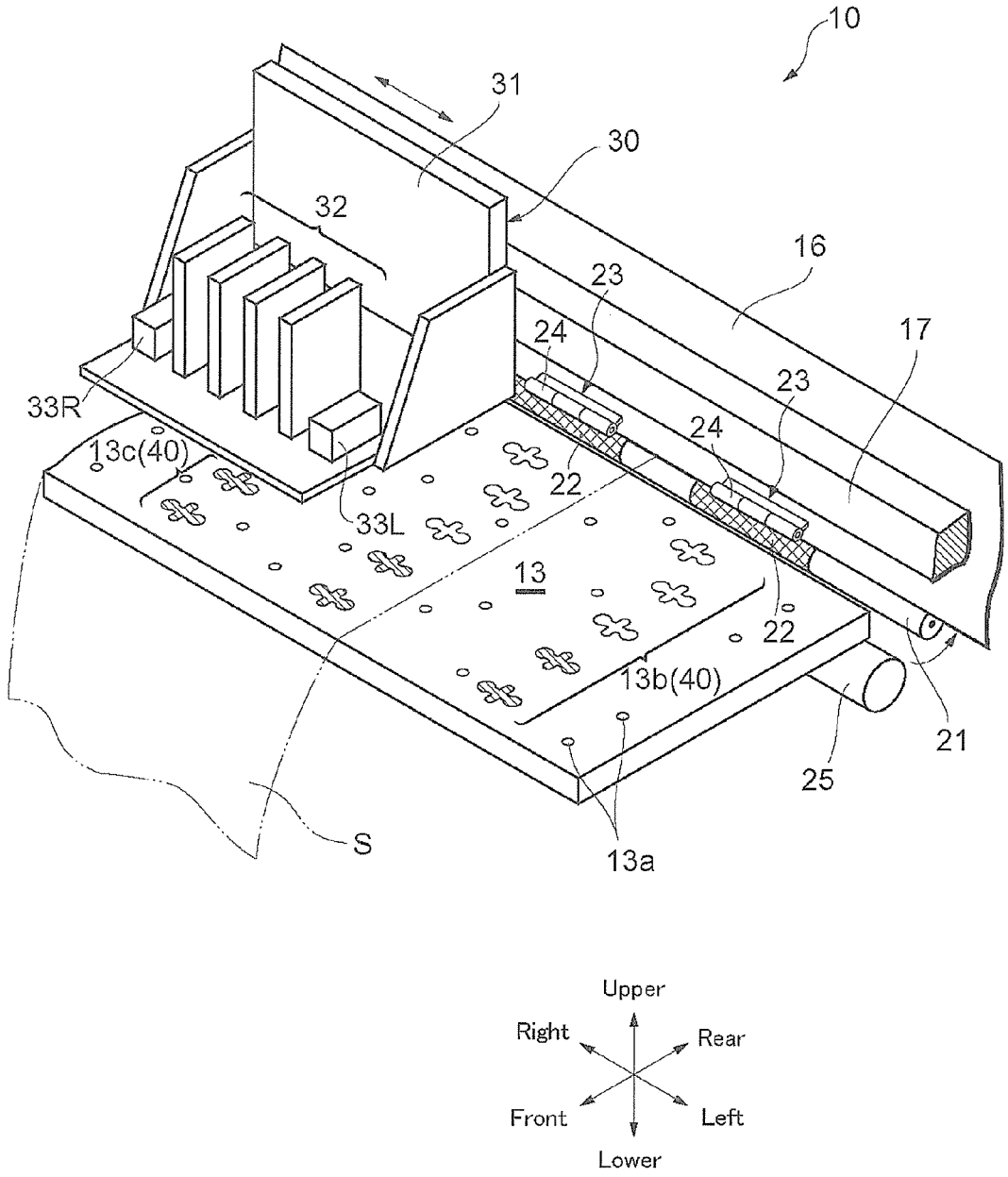
[FIG.2]

The printing unit 30 is, as shown in FIG. 2, mainly structured of a carriage 31, the printer heads 32, the right ultraviolet ray irradiation device 33R and the left ultraviolet ray irradiation device 33L. The printing unit 30 is, for example, provided with a vertically moving mechanism (not shown) for moving the printing unit 30 in an upper and lower direction with respect to the guide rail 17 depending on a thickness of a printing medium (sheet-like medium "S" or plate-like medium "B") to be printed. Therefore, a distance between the printer heads 32 and a printing medium can be set in a predetermined distance which is suitable for printing by the vertically moving mechanism regardless of the thickness of a printing medium that is to be used.

As a mechanism for moving the printing unit 30 along the guide rail 17 reciprocatedly in the right and left direction, for example, a mechanism may be utilized in which the carriage 31 and a right and left carrying belt (not shown) which is arranged on an inside of the upper body part 16 so as to be extended in the right and left direction are connected with each other and the right and left carrying belt is driven by the right and left drive motor 39 (see FIG. 1) which is provided in the right body part 15.

A rear face side of the carriage 31 is fitted to the guide rail 17 so that the carriage 31 is reciprocatedly movable along the guide rail 17 in the right and left direction. Further, the carriage 31 is a mounting base for the printer heads 32, the right ultraviolet ray irradiation device 33R and the left ultraviolet ray irradiation device 33L. The printer heads 32 are, for example, structured of a "Magenta" head, a "Yellow" head, a "Cyan" head and a "Black" head. An under face of each of the printer heads 32 is formed with a plurality of ejection nozzles (not shown) for ejecting "UV" ink toward a lower side.

The right ultraviolet ray irradiation device 33R is adjacently mounted on the right side of the printer heads 32. The right ultraviolet ray irradiation device 33R is mounted with a light source such as an LED in its inside for irradiating ultraviolet rays. Ultraviolet rays are irradiated from the light source toward the lower side. The left ultraviolet ray irradiation device 33L is provided with the same structure as the right ultraviolet ray irradiation device 33R and is adjacently mounted on the left side of the printer heads 32. The "UV" ink which is ejected from the printer head 32 and adhered to a printing medium is surely cured by ultraviolet rays irradiated from the right ultraviolet ray irradiation device 33R and the left ultraviolet ray irradiation device 33L.

As shown in FIG. 2, a plurality of clamp devices 23 is attached to a lower part of the upper body part 16 side by side in the right and left direction. A pinch roller 24 is rotationally attached to a tip end part on the front side of the clamp device 23. A lower side of the pinch roller 24 is disposed with a feed roller 21 formed in a cylindrical tube shape and extended in the right and left direction so as to protrude with respect to the upper face of the platen 13 (see FIGS. 7 and 8). The feed roller 21 is rotationally driven, for example, by the front and rear drive motor 25 provided in the inside of the center body part 12.

The clamp device 23 is capable of being set at a clamp position where the pinch roller 24 is pressed against the feed roller 21 and at an unclamp position where the pinch roller 24 is separated from the feed roller 21. According to this structure, in a state that the clamp device 23 is set at a clamp position so that a printing medium is pinched between the pinch roller 24 and the feed roller 21, when the feed roller 21 is rotated, the printing medium is fed to the front side or rear side by a predetermined distance. An abutting portion of a surface of the feed roller 21 with the pinch roller 24 is, for example, stuck and fixed with a metal mesh member 22. According to this structure, contact resistance of the feed roller 21 with the printing medium is increased and thus the printing medium can be fed to the front side and the rear side with a high degree of accuracy without occurring a slip.

Further, a plurality of suction holes 13*a* is formed in the platen 13 and an under face of the platen 13 is provided with a decompression chamber (not shown) which is in communication with the suction holes 13*a*. For example, when printing is to be performed on a sheet-like medium "S", the sheet-like medium "S" is sucked and fixed to the upper face of the platen 13 by means of setting the decompression chamber at a negative pressure.

In the structure described above, when printing is to be performed on a sheet-like medium "S", in a state that the sheet-like medium "S" is sucked and fixed to the platen 13, "UV" ink is ejected and ultraviolet rays are irradiated while the printing unit 30 is moved in the right and left direction to perform printing. Then, suction of a sheet-like medium "S" to the platen 13 is released and, after the sheet-like medium "S" is fed by a predetermined distance to the front side, the sheet-like medium "S" is fixed to the platen 13 again and ejection of the "UV" ink and irradiation of the ultraviolet rays are performed. Desired printing is performed on the sheet-like medium "S" by performing this operation repeatedly.

In addition to the structure described above, in the printer apparatus 10 to which the present invention is applied, especially for performing printing on a plate-like medium "B", a plurality of feeding auxiliary members 40 is provided in the platen 13 for feeding the plate-like medium "B" in the front and rear direction with a high degree of accuracy. Structure of the feeding auxiliary member 40 will be described below with further reference to FIGS. 3 and 4.

Figure 3:
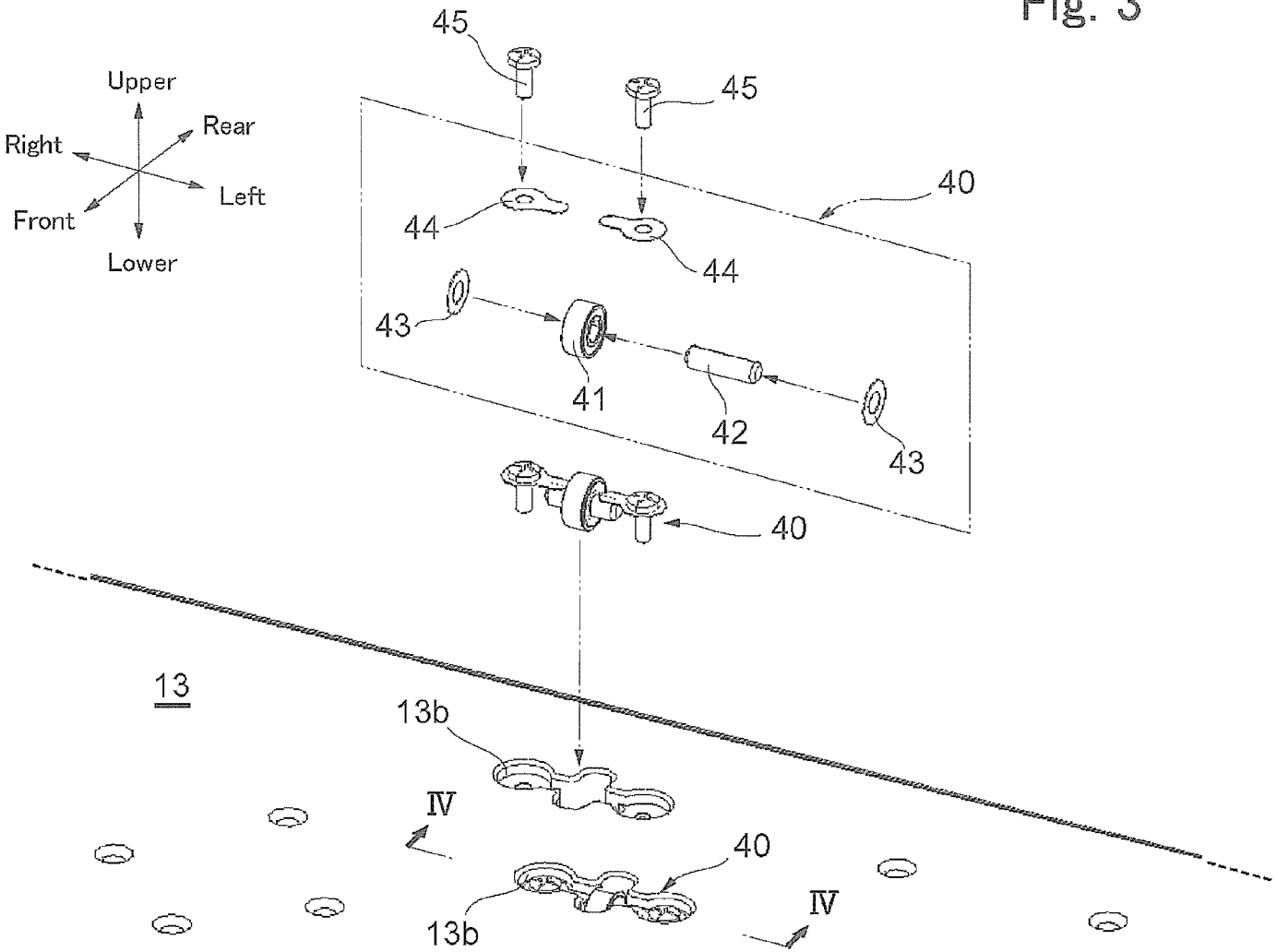
[FIG.3]

A portion surrounded by two-dot chain line in FIG. 3 is an exploded perspective view showing the feeding auxiliary member 40. As shown in the exploded perspective view, the feeding auxiliary member 40 is structured of a support roller 41, a shaft member 42, two washers 43 and two pressing metal fittings 44. The support roller 41 is formed in a ring shape, for example, by using metal material. Further, a bearing, for example, whose outer peripheral diameter is about 7 mm and inner peripheral diameter is about 3 mm may be used as the support roller 41. The shaft member 42 is a shaft which is, for example, formed of metal material and the shaft member 42 is inserted into a center opening part of the support roller 41 in the right and left direction.

The washer 43 is formed in a ring shape, for example, by using metal material. Further, the shaft member 42 is inserted into a center opening part of the washer 43 and two washers 43 are located separately on the right and left sides of the support roller 41. In a state that the shaft member 42 is inserted into the support roller 41 and the washers 43, the support roller 41 and the washers 43 are rotatable with respect to the shaft member 42. The pressing metal fitting 44 is formed in a plate shape, for example, by using SUS (stainless steel) whose thickness is about 0.15-0.20 mm.

After the respective members described above have been assembled as the feeding auxiliary member 40 which is shown at the middle position in FIG. 3, the feeding auxiliary member 40 is accommodated in an accommodating recessed part 13*b* formed in the platen 13 in a state that the shaft member 42 is directed in the right and left direction. Then, when two fixing screws 45 are fastened, the feeding auxiliary member 40 is fixed to the platen 13. FIG. 4 is a cross-sectional view showing a state where the feeding auxiliary member 40 is fixed to the platen 13. As shown in FIG. 4, the shaft member 42 is pressed and fixed to the platen 13 by the pressing metal fittings 44 and the support roller 41 is rotatable with respect to the fixed shaft member 42. In this fixed state, an upper end part of the support roller 41 is protruded about 0.1 mm from the upper face of the platen 13.

When printing is to be performed on a plate-like medium "B" by using the printer apparatus 10 which is structured as described above, a rear side support base 60 is provided on a rear side of the printer apparatus 10 and a front side support base 70 is provided on its front side in order to support the plate-like medium "B" in a substantially horizontal state (see FIGS. 5 and 6). A structure of the rear side support base 60 will be described below with further reference to FIG. 6. The structure of the front side support base 70 is the same as that of the rear side support base 60 and thus its description is omitted.

As shown in FIG. 6, the rear side support base 60 is structured so that a feeding rail 61 whose length in the front and rear direction is about 1.2 m and on which a plurality of carrying rollers 62 is adjacently disposed in the front and rear direction is swingably supported by support legs 63. An inclination adjusting plate 64 is attached so as to connect the feeding rail 61 with the support leg 63 and the inclination adjusting plate 64 is swingably attached to the support leg 63. The inclination adjusting plate 64 is formed with an elongated hole 65. In this structure, when a fixing screw 66 is inserted into the elongated hole 65 and fastened to the feeding rail 61, the inclination adjusting plate 64 and the feeding rail 61 are fixed to each other and an inclination angle of the feeding rail 61 can be arbitrarily set with respect to the support leg 63.

Figure 9:
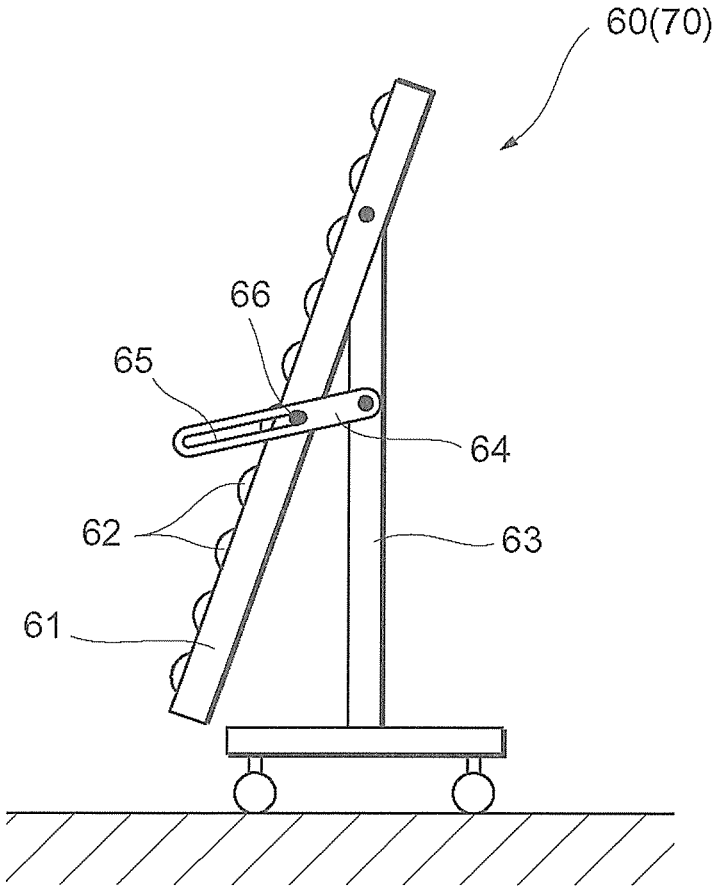
[FIG.9]
Figure 9:
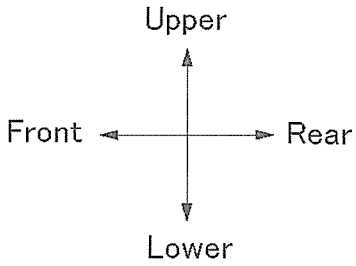

For example, as shown in FIGS. 5 and 6, the feeding rail 61 may be fixed in a substantially horizontal state or, as shown in FIG. 9, the feeding rail 61 may be inclined downward to be folded. When the rear side support base 60 is not used, the rear side support base 60 can be stored in a compact folded state as shown in FIG. 9 and thus saving of a storage space can be attained.

Figure 7:
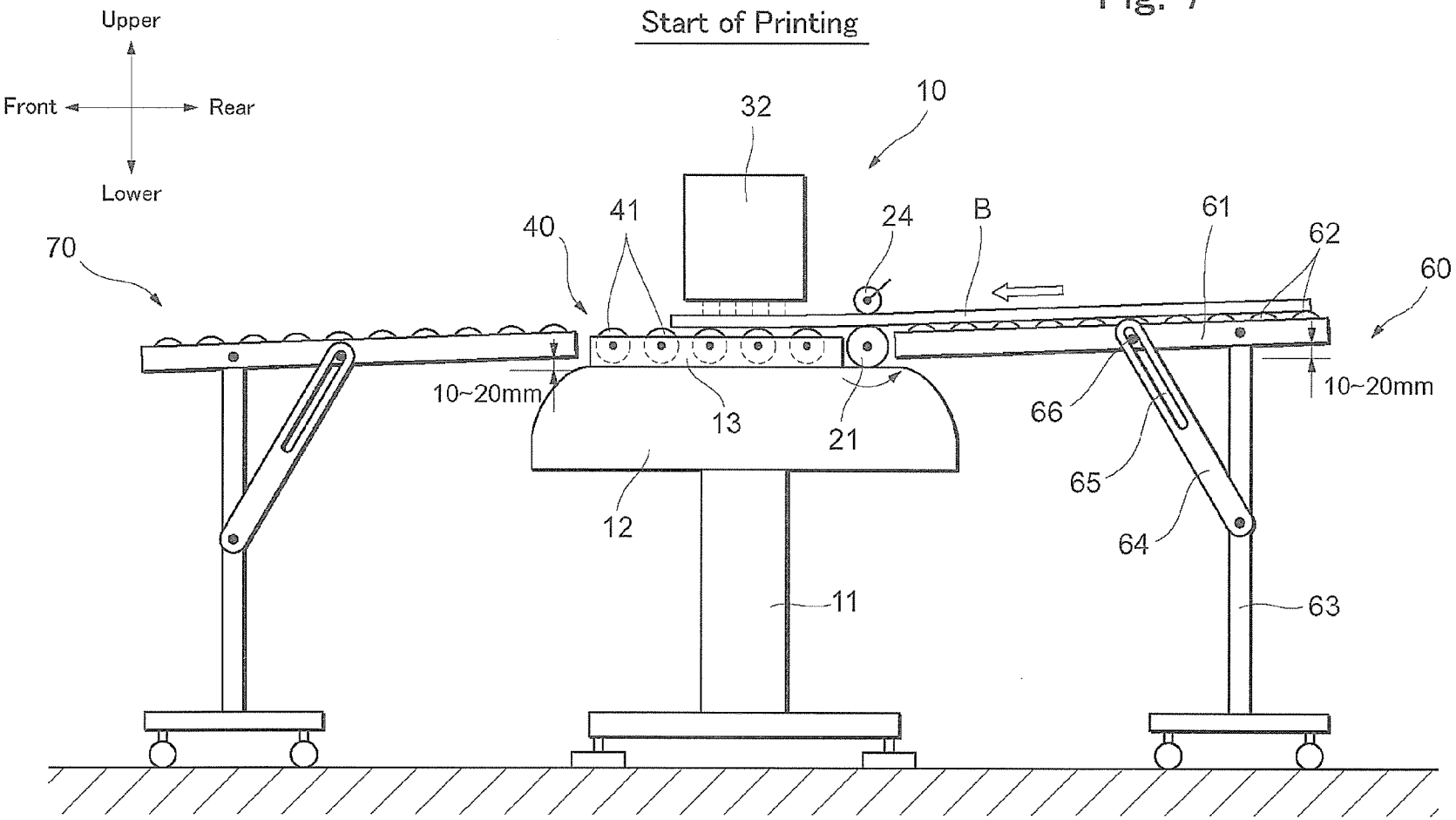
[FIG.7]
Figure 8:
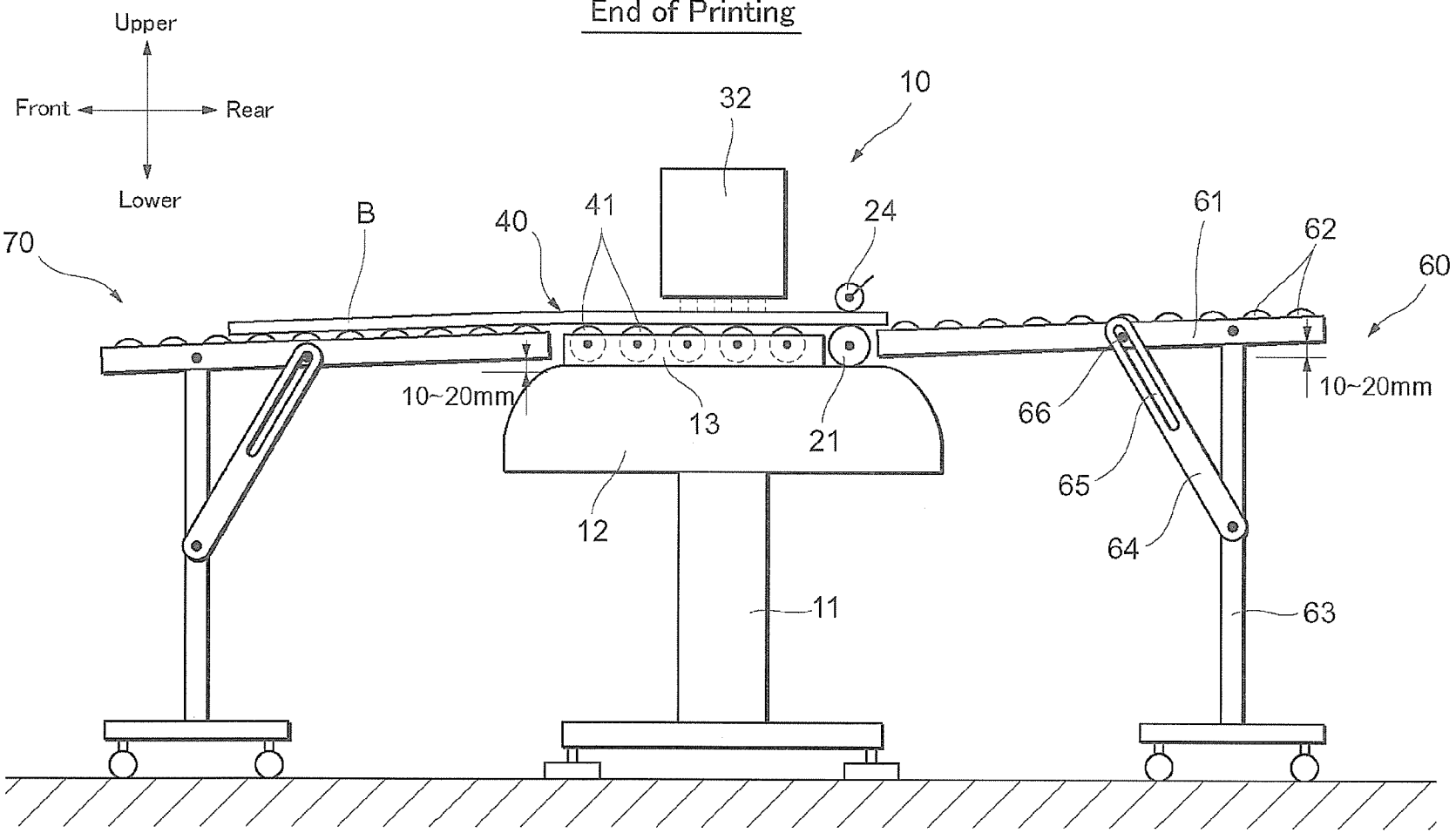
[FIG.8]

Next, in a state that the rear side support base 60 and the front side support base 70 are arranged to the printer apparatus 10, an operation will be described below with further reference to FIGS. 7 and 8 when printing is performed on a platelike medium "B", for example, whose width in the right and left direction is about 1 m and whose length in the front and rear direction is about 1.6 m while the plate-like medium "B" is fed to the front side. FIG. 7 is a side view showing a state when printing is started on a plate-like medium "B" and FIG. 8 is a side view showing a state when printing on the plate-like medium "B" has been finished.

First, an attaching method will be described below in which how the rear side support base 60 and the front side support base 70 are arranged to the printer apparatus 10 is explained. In the rear side support base 60, an inclination angle of the feeding rail 61 with respect to the support leg 63 is set so that the rear end part of the feeding rail 61 is higher about 10-20 mm than its front end part (the feeding rail 61 is inclined forward) (see FIG. 7). Similarly, in the front side support base 70, an inclination angle of the feeding rail is set so that the rear end part of the feeding rail is higher about 10-20 mm than its front end part (see FIG. 7).

According to the above-mentioned setting, when a plate-like medium "B" is to be fed to the front side, printing can be performed while feeding from a higher position to a lower position as a whole. Therefore, the plate-like medium "B" can be fed forward smoothly and an excessive load is prevented from being applied to the front and rear drive motor 25 (feed roller 21). Therefore, a slip does not occur between the feed roller 21 and the plate-like medium "B" and the plate-like medium "B" can be fed to the front side with a high degree of accuracy according to driving of the front and rear drive motor 25.

The rear side support base 60 and the front side support base 70 whose inclination angles are set as described above are arranged on the rear side and the front side of the printer apparatus 10. Then, a plate-like medium "B" is placed on the rear side support base 60 and fed to the front side and, as a result, the plate-like medium "B" is pinched between the pinch rollers 24 and the feed roller 21 and the clamp device 23 is set at the clamp position. In this state, the feed roller 21 is rotated and a front end portion of the plate-like medium "B" is set to be located on a lower side of the printer heads 32 (see FIG. 7).

A "burr" which is formed, for example, when a plate-like medium "B" is performed with a cutting work in a predetermined dimension may be left at a front end part of the plate-like medium "B", or a front end part of the plate-like medium "B" may be curved toward the lower side. Also in this case, since the front end part of the plate-like medium "B" is supported by the support rollers 41 from the lower side, the plate-like medium "B" can be smoothly fed to the front side in a floated state without contacting with the upper face of the platen 13. Therefore, the front end part of the plate-like medium "B" and the upper face of the platen 13 are prevented from being abutted with each other and thus an excessive contacting resistance does not occur.

After the plate-like medium "B" has been fed to a position shown in FIG. 7, a desired printing is performed from a front end part of the plate-like medium "B" to its rear side while performing control which rotates the feed roller 21 for feeding the plate-like medium "B" to the front side and control which moves the carriage 31 in the right and left direction in a combined manner. In this case, as shown in FIG. 8, the plate-like medium "B" is fed to the front side in a state supported by a plurality of the support rollers 41 and the feed roller 21 from the lower side and thus the plate-like medium "B" is not contacted with the upper face of the platen 13.

Further, the support roller 41 is rotatable with respect to the support shaft 42 fixed to be extended in the right and left direction (rotatable along a moving direction of the plate-like medium "B") and thus the plate-like medium "B" can be fed to the front side smoothly. Therefore, a slip does not occur at an abutting portion of the feed roller 21 with the plate-like medium "B" and thus the plate-like medium "B" is fed to the front side by a rotated amount of the feed roller 21 with a high degree of accuracy and a high-quality printing secured with a high degree of positional accuracy can be attained.

In a state that the printing on the plate-like medium "B" has been completed as shown in FIG. 8, the feed roller 21 is rotated to feed the plate-like medium "B" on which printing has been completed to the front side and the plate-like medium "B" is taken out from the front side support base 70. Then, another plate-like medium "B" on which printing is not performed is placed on the rear side support base 60. A front end part of the plate-like medium "B" placed on the rear side support base 60 is pinched between the pinch roller 24 and the feed roller 21 and the clamp device 23 is set at the clamp position. In this state, the feed roller 21 is rotated so that the front end portion of the plate-like medium "B" is located on the lower side of the printer heads 32 as shown in FIG. 7 and printing is started. When this operation is repeatedly performed, a high-quality printing can be performed on a plurality of plate-like media "B" with a high degree of efficiency.

In the embodiment described above, a structure is shown as an example in which five accommodating recessed parts 13*b* are formed in the platen 13 so as to be juxtaposed in the front and rear direction and each of the accommodating recessed parts 13*b* is accommodated with the feeding auxiliary member 40. However, the present invention is not limited to this structure. For example, like the accommodating recessed parts 13*c* hatched in FIG. 2, it may be structured that only two rows of the accommodating recessed parts 13*c* are formed from the front end in the platen 13 and the feeding auxiliary member 40 is accommodated into the accommodating recessed part 13*c*. According to this structure, while attaining the above-mentioned effects, the number of the feeding auxiliary members 40 and the manufacturing number for the accommodating recessed part 13*c* are reduced and thus a manufacturing cost can be reduced. Further, in this structure, the feeding auxiliary member 40 is not disposed at a portion of the platen 13 facing the printer heads 32 and thus the platen 13 can be structured completely flatly. Therefore, for example, when printing is to be performed on a soft sheet-like medium "S", ink from the printer head 32 is stuck to a portion of the soft sheet-like medium "S" which is sucked by the platen 13 to be completely flat shape and thus a high-quality printing can be attained.

Further, in the embodiment described above, as shown in FIGS. 7 and 8, each of the rear side support base 60 and the front side support base 70 is set obliquely so that the rear end part of the feeding rail is set higher about 10-20 mm than its front end part. However, the present invention is not limited to this embodiment. For example, the feeding rails of the rear side support base 60 and the front side support base 70 may be set at respectively different inclination angles.

Figure 10:
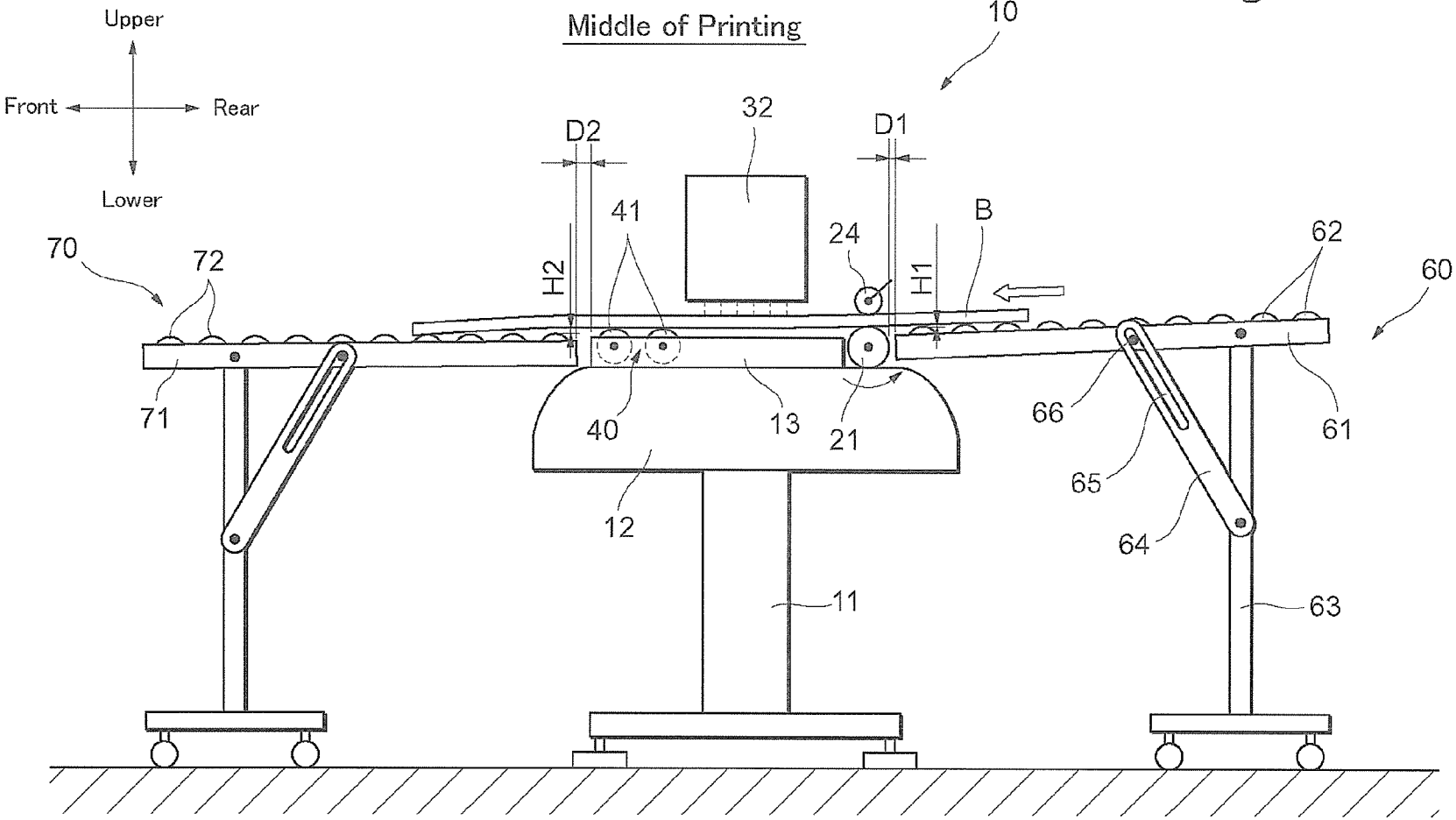
[FIG.10]

FIG. 10 shows a case that the feeding rails of the rear side support base 60 and the front side support base 70 are set at respectively different inclination angles. In the platen 13 shown in FIG. 10, the feeding auxiliary member 40 is disposed on only two rows from the front end. The front end part of the feeding rail 61 of the rear side support base 60 shown in FIG. 10 is located on a lower side with respect to its rear end part and the position of the carrying roller 62 of the front end part is set at the substantially same height as the feed roller 21 (height difference "H1" is substantially zero). The front end part of the feeding rail 71 of the front side support base 70 is located on a slightly lower side with respect to its rear end part and a height difference between the carrying roller 72 of the rear end part and the support roller 41 is set to be "H2". The inclination angle of the feeding rail 61 is set to be larger than the inclination angle of the feeding rail 71.

As shown in FIG. 10, since the feeding rail 61 is inclined, a plate-like medium "B" is smoothly fed to the feed roller 21 by its own weight. Further, since the height difference between the carrying roller 72 and the support roller 41 is set to be "H2", the plate-like medium "B" on which printing has been performed is resiliently bent without contacting the carrying roller 72 on the rear side of the feeding rail 71 with the plate-like medium "B" and the plate-like medium "B" is contacted with the carrying roller 72 in the vicinity of the center of the feeding rail 71. Therefore, since the number of the carrying rollers 72 contacting with the plate-like medium "B" is reduced, resistance acting in the front and rear direction at the time of feeding the plate-like medium "B" is reduced and, even when a further small force is applied, the plate-like medium "B" can be surely fed in the front and rear direction. In addition, the height differences "H1" and "H2", a distance "D1" in the front and rear direction between the feeding rail 61 and the feed roller 21, a distance "D2" in the front and rear direction between the feeding rail 71 and the platen 13, and the inclination angles of the feeding rails 61 and 71 shown in FIG. 10 are adjusted, for example, depending on the own weight and material (surface material) of the plate-like medium "B" so that the plate-like medium "B" is fed to the front side smoothly.

In the embodiment described above, the rear side support base 60 (front side support base 70) is structured as an example so that the inclination angle of the feeding rail 61 is adjusted by using the inclination adjusting plate 64 which is formed with the elongated hole 65. However, the present invention is not limited to this structure. Instead of using the above-mentioned inclination adjusting plate 64, the feeding rail 61 is fixed to a frame member 69 shown in FIG. 6 by using, for example, a screw. Further, a spacer (for example, washer) having a thickness corresponding to the inclination direction and the inclination angle is sandwiched between the frame member 69 and the feeding rail 61. According to this structure, since the inclination angle is determined by the thickness of the spacer, the inclination angle can be easily reproduced.

In the embodiment described above, the rear side support base 60 and the front side support base 70 are used in an inclined state. However, the present invention is not limited to this structure. For example, the rear side support base 60 and the front side support base 70 may be used by adjusting in a substantially horizontal state. In this case, in order that a slip does not occur between the feed roller 21 and a plate-like medium "B", the feed roller 21 is preferably used which is formed with material whose contact resistance is large. Further, an exchanging work of the feed roller 21 for preventing occurrence of slippage requires much labor. On the other hand, a structure for preventing occurrence of slippage in which the rear side support base 60 and the front side support base 70 are set to be inclined is simple and easy. Further, according to this structure, occurrence of slippage can be surely prevented regardless of material of the printing medium and the printing medium can be fed to the front side with a high degree of accuracy.

In the embodiment described above, the structure is shown as an example in which a plurality of the feeding auxiliary members 40 is provided in the platen 13 so as to be juxtaposed in the front and rear direction. However, the position of the feeding auxiliary member 40 provided in the platen 13 is not limited. When the plate-like medium "B" is capable of being fed in the front and rear direction without being contacted with the platen 13, the number and the disposed positions of the feeding auxiliary members 40 can be designed arbitrarily.

Further, in the embodiment described above, the feeding auxiliary member 40 is structured as an example so that the support roller 41 is rotationally attached to the shaft member 42. However, the present invention is not limited to this structure. It may be structured that, for example, instead of the support roller 41, a plurality of members with a small sliding resistance is disposed so as to be slightly protruded from the upper face of the platen 13.

In the embodiment described above, printing is performed by using "UV" ink. However, the present invention may be also applied to a printer apparatus in which, for example, water-based ink, oil-based ink, solvent ink or the like is used.

What is claimed is:

1. A printer apparatus in which ink is ejected to perform printing on a printing medium while a printer head facing the printing medium is relatively moved in a feeding direction and a scanning direction perpendicular to each other with respect to the printing medium that is supported by a medium support means for supporting the printing medium, the printer apparatus comprising:

a medium feeding mechanism in which, in a state that the printing medium is pinched by a pair of pinching rollers that are disposed on an upstream side in the feeding direction with respect to the medium support means, one of the pinching rollers is driven and rotated to feed the printing medium in the feeding direction so that the printing medium is located on the medium support means;

a head moving mechanism which moves the printer head in the scanning direction; and a print control part which performs control for feeding the printing medium by the medium feeding mechanism and control for moving the printer head by the head moving mechanism;

wherein the medium support means is provided with a feeding auxiliary member which is protruded with respect to a support face for supporting the printing medium on a downstream side in the feeding direction with respect to a portion facing the printer head, in a case that a plate-like printing medium is used as the printing medium, the plate-like printing medium being extended longer in the feeding direction than a length in the feeding direction of the medium support means and, when printing is to be performed while the plate-like printing medium is supported and fed in the feeding direction, an upstream side support base is provided on the upstream side in the feeding direction with respect to the pinching rollers, the upstream side support base being detachably attached to the printer apparatus for supporting an unprinted portion of the plate-like printing medium, a downstream side support base is provided on the downstream side in the feeding direction with respect to the medium support means, the downstream side support base being detachably attached to the printer apparatus for supporting a portion having been printed of the plate-like printing medium, and the plate-like printing medium is supported by the upstream side support base and the downstream side support base and supported by the pinching rollers and the feeding auxiliary member and the plate-like printing medium is fed in a state separated from the support face.

2. The printer apparatus according to claim 1, wherein the feeding auxiliary member is provided with a support shaft and a rotation member which is rotationally attached to the support shaft, the feeding auxiliary member is attached to the medium support means so that the support shaft is directed in the scanning direction, and an upper part of the rotation member is protruded on an upper side with respect to the support face.

3. The printer apparatus according to claim 1, wherein each of the upstream side support base and the downstream side support base is structured of a medium support rail, which supports the plate-like printing medium, and a rail support leg which is extended to a lower side with respect to the medium support rail for supporting the medium support rail, an upstream side in the feeding direction of the medium support rail is located on an upper side or in a substantially horizontal state with respect to a downstream side in the feeding direction by means of adjusting an inclination angle of the medium support rail with respect to the rail support leg, and a vertically positional relationship between an end part on the downstream side in the feeding direction of the upstream side support base and the pinching rollers is adjustable, and a vertically positional relationship between an end part on the upstream side in the feeding direction of the downstream side support base and the medium support means is adjustable.

4. The printer apparatus according to claim 2, wherein in a case that a plate-like printing medium is used as the printing medium, the plate-like printing medium being extended longer in the feeding direction than a length in the feeding direction of the medium support means and, when printing is to be performed while the plate-like printing medium is supported and fed in the feeding direction, an upstream side support base is provided on the upstream side in the feeding direction with respect to the pinching rollers, the upstream side support base being detachably attached to the printer apparatus for supporting an unprinted portion of the plate-like printing medium, a downstream side support base is provided on the downstream side in the feeding direction with respect to the medium support means, the downstream side support base being detachably attached to the printer apparatus for supporting a portion having been printed of the plate-like printing medium, and the plate-like printing medium is supported by the upstream side support base and the downstream side support base and supported by the pinching rollers and the feeding auxiliary member and the plate-like printing medium is fed in a state separated from the support face.

* * * * *